United States Patent [19]

Legris et al.

[11] Patent Number: 4,742,194

[45] Date of Patent: May 3, 1988

[54] DEVICE FOR PRODUCING AN ELECTRIC SIGNAL INDICATIVE OF PRESSURE IN A FLUID SYSTEM

[75] Inventors: Andre Legris, Rennes, France; Charles Columb, Le Landeron, Switzerland

[73] Assignee: Societe Anonyme Styled Legris, Rennes, France

[21] Appl. No.: 938,161

[22] Filed: Feb. 2, 1987

Related U.S. Application Data

[63] Continuation of Ser. No. 706,856, Feb. 7, 1985, abandoned.

[30] Foreign Application Priority Data

Jun. 19, 1984 [EP] European Pat. Off. ..... 84/00153

[51] Int. Cl.[4] ..... H01H 35/32

[52] U.S. Cl. ..... 200/83 J; 92/5 R; 200/82 C; 200/81 R

[58] Field of Search ..... 200/153 T, 81 R, 81.9 R, 200/82 R, 82 C, 83 R, 83 J; 73/714, 723; 91/1; 92/5 R; 307/118; 340/606, 611, 626

[56] References Cited

U.S. PATENT DOCUMENTS

| | | | |
|---|---|---|---|
| 2,435,143 | 1/1948 | Knauth | 200/83 J |
| 3,283,092 | 11/1966 | Grostick | 200/83 J |

FOREIGN PATENT DOCUMENTS

| | | |
|---|---|---|
| 695361 | 10/1981 | Canada . |
| 0041007 | 5/1981 | European Pat. Off. . |
| 0046724 | 8/1981 | European Pat. Off. . |
| 1289186 | 2/1962 | France . |

OTHER PUBLICATIONS

Energie-Fluide 1125A, vol. 22, Dec. 1983, No. 9, Paris, France, p. 21.

*Primary Examiner*—G. P. Tolin
*Attorney, Agent, or Firm*—Marks Murase & White

[57] ABSTRACT

Improvement to electro-fluid relays useable to signal either the maximum or minimum limit of pressure in a fluid system, or the position of a movable part of a jack.

The relay is constituted of a pipe fitting (1,2) attached directly onto an apparatus (5) or onto a pipe and including a body presenting a pneumatic control inlet (6) in communication with the said apparatus or the said piping, the said control inlet (6) being linked to a space situated on one side of an elastic membrane (16) submitted to the fluid pressure established in the control inlet (6), the said membrane (16) being linked by a transmission member (18) sliding in the body to a means of control (22) of an electric contactor (23).

The invention is utilized for the control of a jack.

13 Claims, 2 Drawing Sheets

1b
2b
4b
9b
10b 16
1
37
24
2
36
18
6
22
23

DEVICE FOR PRODUCING AN ELECTRIC SIGNAL INDICATIVE OF PRESSURE IN A FLUID SYSTEM

This application is a continuation of application Ser. No. 706,856, filed Feb. 7, 1985, now abandoned.

The object of the present invention is an improvement to electro-fluid devices useable, for example to signal the position of a movable part of a jack or the minimum or maximum limit of pressure in a pressurized fluid system.

The skilled artisan knows of electro-fluid relays comprising on the one hand an electrical input, an output furnishing an electrical signal, and a pressurized fluid control inlet, and on the other hand, within a hollow body a commutation device provided with a flexible membrane and a movable translation piece which is able to press and to release the button of an electric contactor permitting the delivery or the stopping of an electric signal.

Such a relay which is well-known in itself, may be employed in the control circuits of the movable part of a pneumatic jack, or on fluid systems of any nature, to electrically signal in sufficient time the minimum or maximum limit prior to unsafe functioning of these systems. This relay permits in this case the control of the pressures of fluid or of liquids in tanks, a signal being deliverable by the appearance or disappearance of an electric current. This relay may equally be employed with the electro-pneumatic automation systems of machines and equipment in which a pressure of a pneumatic fluid should be transformed into an electric signal to activate one or several electric components at the time of the successive sequences of the processes of automation.

When this known relay is put into operation in a system such as mentioned here above, it is customary to arrange it either in a cabinet containing other pneumatic components, or on a plate member mounted near to the jack with which it is associated. This mode of installation presents all the disadvantages which can result from the great length of piping necessary in this case, namely the probability of their deterioration, their losses of charge or delays of transmission and the accumulation of the jacks' lubricating oil obstructing the rapid transmission of control signals by stagnation in the corresponding piping.

In the case of a search to obtain an electric signal to indicate the passage of the piston of a jack to the extreme limit of the completion of its stroke linked to a pressure drop relay mounted on an associable base, this embodiment presents the major disadvantages described above.

These disadvantages are increased if the supply system of the jack includes a pneumatic speed adjuster, because in this case an intermediate base must be used to effect the connections between this speed adjuster, the pressure relay, the jack and the electric contactor on an associable base in the case of a mixed electro-pneumatic installation.

These disadvantages have been eliminated in the case of an installation functioning entirely by pneumatic means as in the French Pat. No. 80.11560, however in mixed electro-pneumatic installations the problems was not resolved and it was always indispenable, to make the connections between the pneumatic and electrical means, to utilize a pressure electric contactor mounted on a pneumatic associable base.

The object of the device according to the invention is to eliminate the aforesaid disadvantages.

According to the present invention the relay is constituted of a pipe fitting attached directly onto an apparatus or onto a pipe and including a body presenting a pneumatic control inlet in communication with the said apparatus or the said piping, the said control inlet being linked to a space situated on one side of an elastic membrane submitted to a fluid pressure established within the control inlet, the said membrane being linked by a sliding transmission member in the body to a means of control of an electric contactor linked to an electrical supply circuit and to an output signal emission circuit in function to the position of the said membrane.

This disposition permits a direct liaison between the relay and the jack, which permits an easy and simplified assembly when the speed adjuster needs to be associated with the supply of the jack.

The application of this particularly simple device is realized in the pneumatic industry and the modern electric and electronic cyles of automation of all sorts of machines such as the mechanical industry, packaging, bottling, the footwear industry, pumps, the distribution of liquids or gases under pressure, the detection of liquid levels, or the safety of the detection of moderate fluid pressures.

Other characteristics and advantages of the invention will be better understood in the reading of the description which will follow of several embodiments and by referring to the attached drawings, in which.

Figure 1:
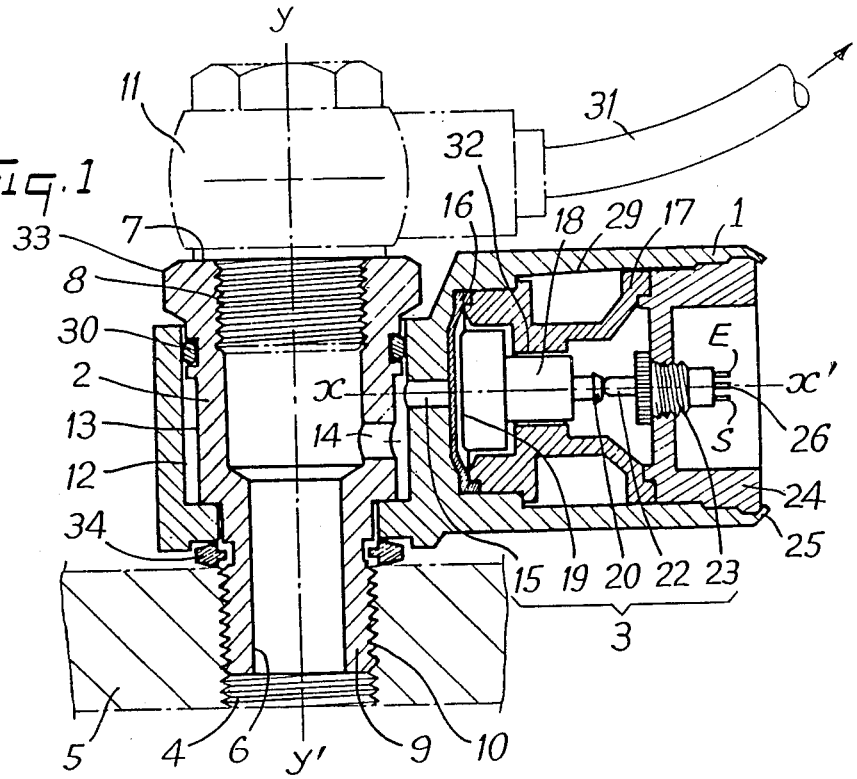
FIG. 1 is a longitudinal section view of an electro-fluid relay according to the invention.

The electro-fluid relay represented in FIG. 1 presents the form of a pipe fitting constituted of a hollow screw 2 whose axis YY' is disposed vertically and on which is mounted, by a bore 12, a body 1 whose axis XX' is disposed horizontally and perpendicularly to the axis YY' of the hollow screw 2.

In the body 1, is provided a shouldered bore 29 destined to receive a commutation device 3 including different members which will be described later. The sleeve 2 mounted in the bore 12 of the body 1 with the interposition of a seal 30, presents at one of its ends 9 a threaded tubing 10 which is screwed with the interposition of a seal 34 into a tapped hole 4 of a body of the jack 5, thus assuring a direct attachment of the pipe fitting onto the jack.

At its end 7 the screw 2 presents a polygonal exterior outline 33 permitting the assurance of the tightening of the screw by means of an appropriate tool.

Sleeve 2 may take the form of a hollow screw which presents a cylindrical form with a bore forming an axial conduit 6 of passage of a fluid which emerges on one side by the tubing 10 into the body of the jack 5 and on the other side by its end 7 into the pipe fitting 11 whose threaded part is inserted into a tapped hole 8 provided in the hollow screw 2. The pipe fitting 11 which is linked by a conduit 31 to a distributor and to a source of fluid not represented on the drawing, supplies the jack 5 with fluid.

In the annular space made between the bore 12 of the body 1 and the cylindrical part 13 of the screw 2 emerges at least one orifice 14 from the screw 2 permitting the fluid from the conduit 6 to pass by the channel 15 in the body 1 to activate the commutation device 3.

The cummutation device 3 includes a revolving piece 17 immobilized in the bore 29 of the body 1 of axis XX' by a plug 24 which is fixed into the body 1 by means of a lip 25 provided at one of the ends of the body and crimped onto the plug 24.

Between the bottom of the bore 29 and the piece 17 is maintained clamped in a leakproof fashion the peripheral border of a membrane 16 which is in contact on one side with the fluid coming from the conduit 6. The other side of membrane 16 is in contact with a transmission member 18 disposed in a bore 32 of body 1. Bore 32 defines a first axial cavity adjacent membrane 16 and a second axial cavity adjacent the first axial cavity. The second axial cavity has a smaller diameter than the first axial cavity. Transmission member 18 has a first axial segment small enough to fit in the first cavity but not the second. This limits the travel of transmission member 18 away from the membrane (to the right in the figure) thereby preventing damage to contactor 23. The distal end 20 of transmission member 18 is in contact with a control member or push button 22 of an electric contactor 23 screwed into the plug 24. The electric contactor 23 includes electric connection members 26 which are linked to an electric current supply circuit and to an output signal emission circuit in function of the position of the membrane 16.

The directions of inflow and outflow of the conduit 31 and the electrical connections 26 of the conductor 23 are situated along the axis XX' or along a plane which is parallel to it. The interest of this disposition is to permit orderly pneumatic or electrical installations as well as their appropriate orientation. The baffling created by the orifices 14 and 15 within the annular space between the bore 12 and the cylindrical part 13 of the screw permits, in combination with an appropriate positioning of this relay relative to the jack, the prevention of stagnation around the membrane of the pressurized fluid supply. This electro-fluid relay, currently used in pairs and each mounted on the supply orifices of a jack, utilizes the evolution of pressures on either side of the piston to emit signals for the end of a stroke.

A jack exhaust pressure being present in the conduit 6 of the relay, it acts on the elastic membrane 16 which by its deformation causes the displacement toward the right of the transmission member 18 initiates the cutting of the electric signal.

This exhaust pressure of the fluid coming from the jack decreases progressively, the volume of air within the cylinder on which the relay is attached diminishes with the stroke of the piston. As soon as the piston of the jack has reached its minimum value and the pressure in the orifice 15 has reached a certain defined minimum limit, that pressure is no longer sufficient to maintain by the deformation of the membrane the necessary force against the transmission member 18 which by this fact is pulled back by the spring of the button of the electric contactor. The electric contactor then delivers an electric signal S of the completion of a stroke, for example to the electrovalve of an electrically controlled fluid distributor.

Figure 2:
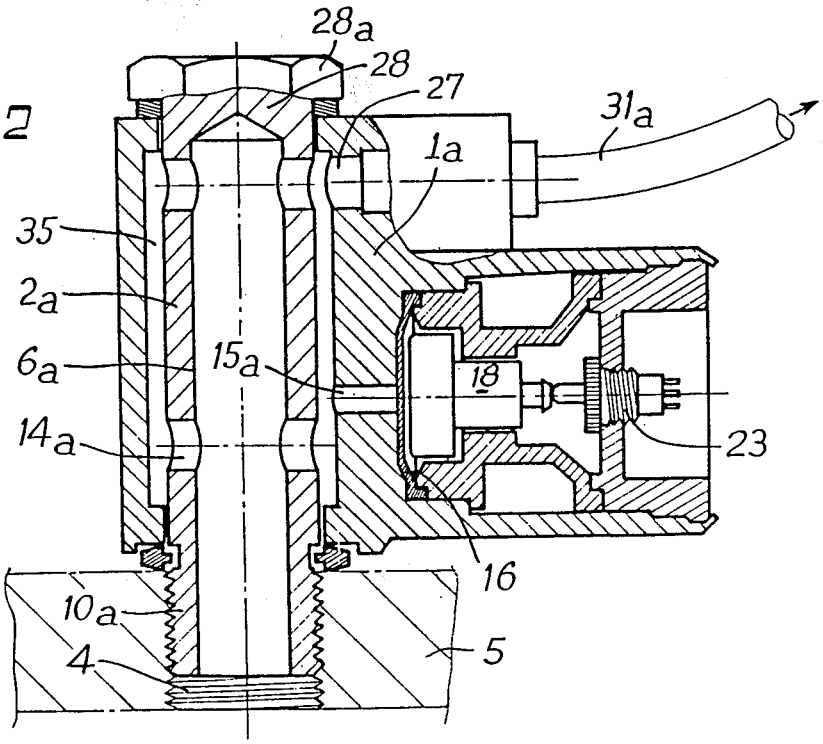
FIG. 2 is a longitudinal section view of another embodiment of a relay in which the supply channel of the system towards the pump is integrated into the body of the relay.

In FIG. 2 has been represented another embodiment of the relay in which the hollow screw **2*a* presents at its lower part a threaded tubing 10*a* which is screwed into a tapped hole 4 of the jack and the axial conduit 6*a* which opens into the jack 5 at its lower part, is closed at its upper part by a head 28 provided with a polygonal exterior part 28*a*. The screw 2*a* presents orifices 14*a* putting into communication the conduit 6*a* of the screw with an annular space 35 provided between the screw 2*a* and the body of the pipe fitting 1*a*, the said space 35 being in communication by a conduit 27 provided in the body 1*a* and by a conduit 31*a* with a source of fluid supply by the intermediary of a distributor. In the annular space 35 opens the channel 15*a*** of the master control of the commutation device.

This embodiment presents the advantage of a greater compactness of the unity comprised of the pipe fitting, relay and supply of the jack. However, the embodiment shown in FIG. 1 renders possible the implantation of a speed adjuster onto the jack when this is necessary.

Figure 3:
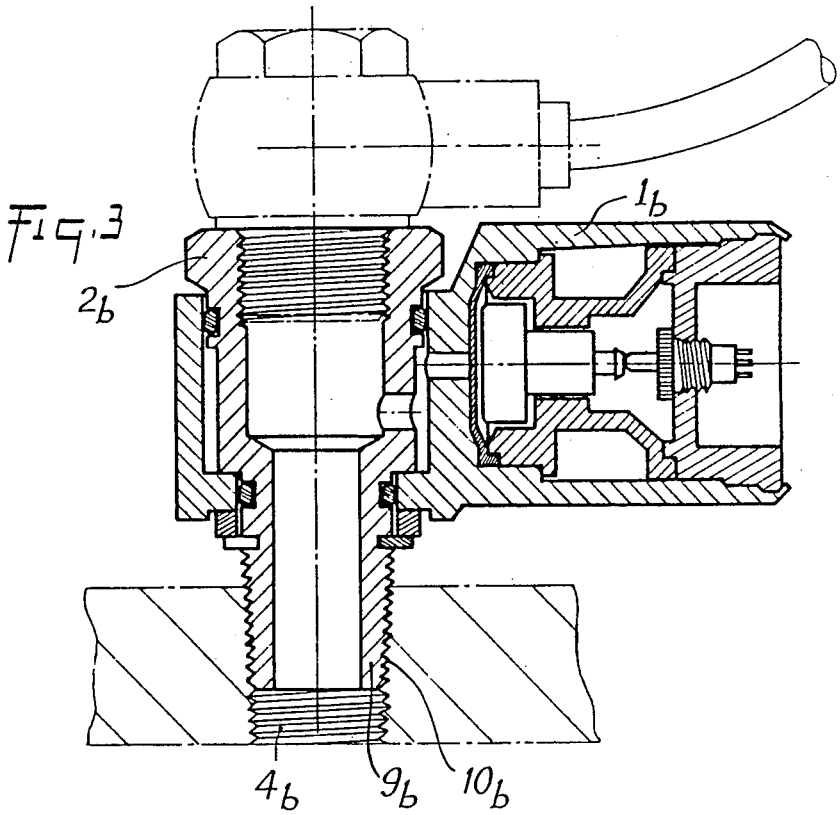
FIG. 3 is a longitudinal section view of a relay of which the hollow screw presents a conical male threading.

Another embodiment of the relay has been recognized in FIG. 3 in which the end **9*b* of the hollow screw 2*b* includes a conical male thread ding 10*b* which can be inserted into the tapped orifice 4*b*** of the jack whose thread profile presents the same characteristics as that of the threading of the relay. This disposition may be utilized when one seeks a tight seal in the threads.

Figure 4:
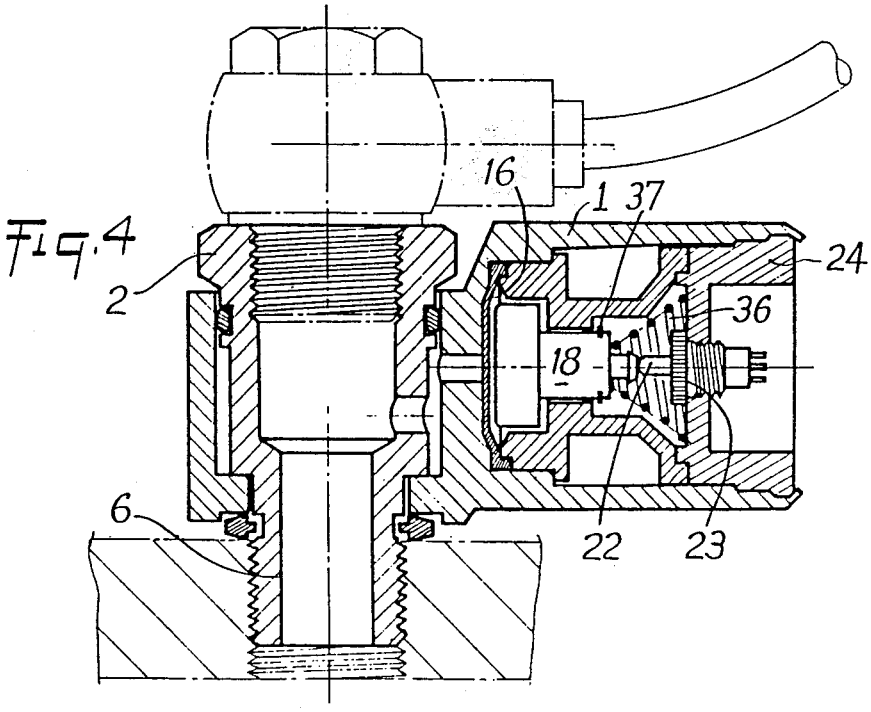
FIG. 4 is a longitudinal section view of a relay of which the return of the transmission member is assured by a spring.

In the embodiment represented in FIG. 4 one utilizes a conical spring 36 disposed in a substantially funnel-shaped or conical cavity defined in bore 32 pressing on one side against the plug 24 and on the other side against the transmission member 18, the said spring acting on the member 18 and the membrane 16 counter to the pressure of the fluid present in the conduit 6. The aim of this spring 36 is to assist the elastic member within the electric contactor 23 and which acts on the control member 22. In this case an abutting member 37 may be provided on the transmission member 18.

The electric contactor 23 may be made either to deliver an electric current at rest or to cut off, at rest, an electric current. It is equally possible to utilize an electric contactor 23 which delivers, at rest, an electric signal to a first circuit and, in operating position, an electric signal to a second circuit.

Of course, the invention is not limitative and those skilled in the art could contribute modifications to it without that altering the domaine of the invention.

We claim:

1. A device for producing an electric signal indicative of pressure in a fluid system, said fluid system including a first apparatus and a pipe in fluid communication with said first apparatus, said device comprising:

a first hollow body in fluid communication with at least one of said first apparatus and said pipe through a control inlet defined in said first hollow body;

a second hollow body attached to said first hollow body, said second hollow body having a bore defining first axial cavity with a first internal diameter and a second axial cavity adjacent said first axial cavity with a second internal diameter less than said first internal diameter thus defining an inwardly-protruding lip between said first axial cavity and said second axial cavity;

an elastic membrane disposed within said second hollow body, having one side at least partially defining with said first hollow body a space in fluid communication with said control inlet, and movable by fluid pressure in said control inlet;

a mechanical force transmission member on another side of said membrane opposed to said one side of said membrane, said member having a first axial segment, with a first external diameter less than said first internal diameter and greater than said second internal diameter, disposed in said first axial cavity, and a second axial segment, with a second external diameter less than said second internal diameter, disposed in said second axial cavity, thereby defining a shoulder between said first axial segment and second axial segment, said member being thereby adapted to be movable by said membrane up to a limit where said shoulder contacts said lip;

wherein said bore of second hollow body further defines a substantially conical third axial cavity adjacent said second axial cavity, and an end portion adjacent said third axial cavity, wherein said electrical contactor is supported by said end portion, and wherein said device further comprises a conical spring arranged in said third axial cavity between said end portion and said second axial segment and surrounding said said contactor for urging said mechanical force transmission member toward said membrane;

and an electric contactor electrically connected to a source of electricity and having an element movable between a first position and a second position by said mechanical force transmission member, whereby said electrical contactor produces said electric signal in accordance with a position assumed by said membrane in response to a pressure at said control inlet.

2. A device as claimed in claim 1 in which motion of said elastic membrane, mechanical force transmission member, and electric contactor element are colinear in a line substantially orthogonal to a longitudinal axis of said control inlet.

3. A device as claimed in claim 1 wherein said space comprises a channel defined in said second hollow body, and wherein said first hollow body comprises a hollow sleeve received in a bore defined in said second hollow body.

4. A device as claimed in claim 3 wherein said sleeve is threaded at one end to connect with said first apparatus and threaded at its other end to connect with said pipe.

5. A device as claimed in claim 4 wherein an axial portion of an outer surface of said sleeve is polygonal to facilitate connection of said sleeve and said first apparatus.

6. A device as claimed in claim 3 wherein said sleeve is threaded at one end and closed at its other end, and includes a pair of radial orifices at least partially defining a fluid path between said pipe and said channel.

7. A device as claimed in claim 1 wherein said sleeve is threaded at one end to connect with said first apparatus and threaded at its other end to connect with said pipe.

8. A device as claimed in claim 7 wherein an axial portion of an outer surface of said sleeve is polygonal to facilitate connection of said sleeve and said first apparatus.

9. A device as claimed in claim 1 wherein said sleeve is threaded at one end and closed at its other end, and includes a pair of radial orifices at least partially defining a fluid path between said pipe and said channel.

10. A device as claimed in claim 1 wherein said movable electric contactor element produces said electric signal when in said first position and not when in said second position.

11. A device as claimed in claim 1 wherein said movable electric contactor element produces said electric signal when in said second position and not when in said first position.

12. A device as claimed in claim 1 wherein said electric contactor is urged toward said first position by an elastic member.

13. A device for producing an electric signal indicative of pressure in a fluid system, said fluid system including a first apparatus and a fluid conduit, said device comprising:

a sleeve connected at one axial end to said first apparatus and at a second axial end to said fluid conduit and defining a fluid path between said first apparatus and said fluid conduit;

a body having (i) a bore receiving said sleeve, (ii) a channel in fluid communication with said fluid path through an orifice in said sleeve, and (iii) a first axial cavity having a first internal diameter, a second axial cavity adjacent said first axial cavity and having a second internal diameter less than said first internal diameter thereby defining a lip, and a third axial cavity adjacent said second axial cavity and having a generally conical configuration;

a membrane disposed between said channel and said first axial cavity and preventing fluid flow therebetween, said membrane being displaceable between a first position and a second position by fluid entering said channel;

a mechanical force transmission member arranged in said body adjacent said membrane; said member having a first axial segment, with a first external diameter less than said first internal diameter and greater than said second internal diameter, disposed in said first axial cavity, and a second axial segment, with a second external diameter less than said second internal diameter, disposed in said second axial cavity, said member being thereby adapted to be movable by said membrane up to a limit where said first axial segment contacts said lip;

an electric contactor disposed in said body and having a movable element engagable with said mechanical force transmission member to be moved thereby, said electric contactor being electrically connected to a current source to produce a signal indicative of a position of said movable element; and a conical spring arranged in said third axial cavity and surrounding said movable element and arranged between said body and said force transmission member to urge said force transmission member towards said membrane.

* * * * *